US006385944B1

(12) United States Patent
Taniguchi et al.

(10) Patent No.: US 6,385,944 B1
(45) Date of Patent: May 14, 2002

(54) COIN PACKAGING APPARATUS

(75) Inventors: Masanori Taniguchi; Kazuma Sugahara; Masaaki Suzuki; Fumio Kibihara, all of Himeji (JP)

(73) Assignee: Glory Kogyo Kabushiki Kaisha, Himeji (JP)

( * ) Notice: Subject to any disclaimer, the term of this patent is extended or adjusted under 35 U.S.C. 154(b) by 0 days.

(21) Appl. No.: 09/450,664

(22) Filed: Nov. 30, 1999

(30) Foreign Application Priority Data

Nov. 30, 1998 (JP) ..... 10-339667

(51) Int. Cl.[7] ..... B65B 11/00

(52) U.S. Cl. ..... 53/168; 53/211; 53/212; 53/52

(58) Field of Search ..... 53/203, 211, 212, 53/216, 217, 52, 507, 508; 453/31, 61, 62

(56) References Cited

U.S. PATENT DOCUMENTS

| | | | | |
|---|---|---|---|---|
| 4,102,110 | A | * | 7/1978 | Iizuka et al. |
| 5,435,113 | A | * | 7/1995 | Oikawa |
| 5,513,481 | A | * | 5/1996 | Ozeki et al. |
| 5,540,031 | A | * | 7/1996 | Ozeki et al. |
| 5,557,908 | A | * | 9/1996 | Ozeki et al. |
| 5,573,457 | A | * | 11/1996 | Watts et al. |
| 5,970,683 | A | * | 10/1999 | Miyamoto et al. |
| 6,209,294 | B1 | * | 4/2001 | Hibari |

FOREIGN PATENT DOCUMENTS

| | | |
|---|---|---|
| JP | 2-1612 | 1/1909 |
| JP | 6-255608 | 9/1994 |
| JP | 6-278708 | 10/1994 |
| JP | 8-113216 | 5/1996 |

* cited by examiner

*Primary Examiner*—Eugene Kim
(74) *Attorney, Agent, or Firm*—Wenderoth, Lind & Ponack, L.L.P.

(57) ABSTRACT

A coin packaging apparatus has a structure facilitating confirmation of the correction or incorrectness of packaging paper when the wrong packaging paper is set, and facilitates replacement of the packaging paper. A comparator compares the paper width value of the packaging paper detected by a paper width detecting device with a recommended paper width value at a predetermined timing before starting a coin packaging operation, to progress the operation under a judgement that the packaging paper is correct if the result of the comparison indicates that the calculated paper width value is within the predetermined allowable range for the recommended paper width value, and to display the incorrectness of the packaging paper and the recommended paper width value and have the packaging paper gripped by the paper supply/discharge device be discharged automatically or manually under a judgement that the packaging paper is wrong if the calculated paper width value is out of the predetermined allowable range for the recommended paper width value.

8 Claims, 8 Drawing Sheets

FIG. 3

| COIN TYPE | UNIT NUMBER OF COINS PER PACKAGE | RECOMMENDED WIDTH |
|---|---|---|
| 1 CENT | 50 | 97.0 |
| 5 CENT | 20 | 60.5 |
| 5 CENT | 40 | 99.0 |
| 10 CENT | 50 | 88.5 |
| 25 CENT | 20 | 57.0 |
| 25 CENT | 40 | 91.5 |
| 50 CENT | 20 | 64.5 |
| 1 DOLLAR | 25 | 71.5 |
| TOKEN | 20 | 74.0 |

COIN PACKAGING APPARATUS

BACKGROUND OF THE INVENTION

This invention relates to a coin packaging apparatus configured to package a stack of coins by winding packaging paper onto its side surface, and more particularly to a coin packaging apparatus using different kinds of packaging paper depending upon the sort or number of coins to be packaged.

FIG. 9 is a perspective view showing an outline of a conventional coin packaging apparatus.

The conventional coin packaging apparatus 100 shown in FIG. 9 includes a coin insertion hopper 103 which opens to the top portion of a machine unit 102. A first coin supply rotating plate 104 is driven to rotate to receive and supply coins inserted into the coin insertion hopper 103. A second coin supply rotating plate 105 is driven to rotate to supply coins delivered from the first coin supply rotating plate 104 to have them sequentially processed one by one. A coin passage 106 extends substantially tangential to the second coin supply rotating plate 105 to perform separation, counting and other processing of coins supplied from the second coin supply rotating plate 105. A coin stacking portion 107 is located at one end of the coin passage 106 to stack a predetermined number of coins into the form of a rod. Three packaging rollers 109 are located under the coin stacking portion 107 to receive a rod of stacked coins from the coin stacking portion 107 and to wind packaging paper 108 wider than the length of the rod of stacked coins onto the side surface of the rod of stacked coins. A paper feeding roller 112 supplies the packaging paper 108. A cutter cuts the packaging paper 108 into a desired length. Folding heads 114 are located near the top and the bottom of the packaging roller 109 to fold and tightly press upper end lower ends of packaging paper 108 wound onto the side surface of the rod of stacked coins to make a packaged rod of coins. A packaged coin outlet 111 is located under part of the machine unit 102 to discharge packed rods of coins. Three packing rollers 109 and the folding heads 114 form a coin packaging portion 110.

As apparent from the structure explained above, the conventional coin packaging apparatus 100 is configured to package each rod of stacked coins by activating three packing rollers 109 to wind the packaging paper 108 wider than the length of the rod of stacked coins onto the side surface of the rod of stacked coins, and by activating the folding heads 114 to fold and tightly press upper and lower ends of the packaging paper 108. If the thickness of coins to be packaged varies among different kinds of coins, or the number of coins to be packaged as a single rod varies, the packing paper 108 is changed from a wrong one to a correct one having a width meeting the kind and number of coins undergoing the packaging process.

An invention of a coin packaging apparatus, intended to confirm whether predetermined packaging paper with a suitable width was not or was set upon replacement of packing paper, is disclosed in Japanese Patent Laid-Open Publication No. 113216-1996.

The coin packaging apparatus according to the invention disclosed in Japanese Patent Laid-Open Publication No. 1132161996 includes a packaging paper width detecting mechanism mounted for vertical movement near a packaging paper table supporting a roll of packaging paper thereon and having a packaging paper height detecting lever which can be put on the top surface of the packaging paper roll on the packaging paper table. A fold-and-press mechanism has a pair of fold-and-press heads vertically movable toward and away from each other between pause positions and fold-and-press positions to fold and press upper and lower ends of the packaging paper wound on stacked coins when they are moved to the fold-and-press positions. A coupling shaft is located between the packaging paper width detecting mechanism and the fold-and-press mechanism to vertically shift the pause position of the upper fold-and-press head in accordance with the height of the packaging paper height detecting lever. This coin packaging apparatus further includes a detector device provided in the fold-and-press machine to detect the relative distance between the fold-and-press heads and thereby detect the paper width of the packaging paper roll on the packaging paper table. An operational device is provided through which the type of coins corresponding to the packaging paper roll on the packaging paper table can be input. A memory stores a plurality of paper widths of packaging rolls for different types of coins as reference paper widths. An identify/control device identifies whether a particular packaging paper roll on the packaging paper table corresponds to the type of coins selected through the operational device by comparing the paper width of the packing paper roll detected by the detector device with one of the reference paper width in the memory intended for the selected type of coins. The identify/control device is configured to output an alarm when the paper width of the packaging paper roll detected by the detector device does not meet the reference paper width in the memory for the type of coins selected through the operational device. That is, the coin packaging apparatus according to the invention disclosed in Japanese Patent Laid-Open Publication No. 113216-1996 is configured to detect the paper width of the packaging paper, confirm whether the packaging paper corresponds to the selected type of coins, and output an alarm when the packaging paper does not meet the selected type of coins.

Coin packaging apparatuses of this type, however, are usually configured to simply output an alarm when any of various abnormal matters occur. Therefore, even when an alarm was output, an operator could not locate which type of abnormality was meant by the alarm. As a result, the operator was compelled to refer to operation manuals or check various points of the coin packaging apparatuses, and it took him much time to replace the packaging paper with predetermined packaging paper of a correct paper width and to actually package the coins.

Even in packaging apparatuses designed to indicate that the alarm means that the wrong packaging paper is set, there still remained the problem that operators had to locate the correct packaging paper, and often set another wrong packaging paper.

Moreover, when the packaging paper is not the correct one for the selected type of coins, the packaging paper should be immediately replaced. However, since the packaging paper was gripped by the packaging paper supply rollers, the packaging paper had to be forcibly pulled out to remove it, thus the apparatus was inconvenient for replacement of the packaging paper.

SUMMARY OF THE INVENTION

It is therefore an object of the invention to provide a coin packaging apparatus having a structure which makes it easy to recognize that the wrong packaging paper is set, if so, and to know the correct packaging paper, and also makes it easy to replace the packaging paper.

According to this invention, there is provided a coin packaging apparatus comprising: a setting device permitting an operation to set conditions of a packaging operation including a coin type and a unit number of coins per package, and to enter a command to start the packaging operation. A memory stores information including coin types and unit numbers of coins per package and recommended paper widths of packaging paper. A coin stacking device stacks coins of the set type and the set unit number of coins per package in the form of a rod. A paper supply device supplies packaging paper to be used for packaging the rod of coins stacked by the coin stacking device. A coin packaging device winds the packaging paper around the side surface of the rod of stacked coins and folds and presses upper and lower ends of said packaging paper to package the rod of stacked coins. A paper width detecting device detects the paper width of the packaging paper set on the paper supply device. A comparator compares the value of the detected paper width of the packaging paper with a predetermined allowable range for the recommended paper width value of packaging paper suitable for the coins of the set type and the set unit number of coins per package. A display indicates the incorrectness of the packaging paper and the recommended paper width value when the result of comparison indicates that the paper width value of the packaging paper is out of the predetermined allowable range for the recommended paper width value.

In the coin packaging apparatus according to the invention, since a display indicates that the packaging paper currently set is wrong and the value of the recommended paper width, operators can immediately know that the current abnormality is a mismatch of packaging paper, and the recommended paper width of packaging paper suitable for the coin type and the unit number of coins per package. Therefore, the operators can undertake replacement of the wrong packaging paper with the correct packaging paper for the coin type and the unit number of coins per package. When the apparatus includes a paper supply/discharge device, unlike the conventional apparatus using paper supply rollers exclusive for paper supply operations, the apparatus is also operative for paper discharge to quickly discharge the packaging paper heretofore gripped by the paper supply/discharge device.

If the comparator is configured to execute comparison when a coin type and a unit number of coins per package is selected through the setting device, or when a packaging start command is input through the setting device, erroneous supply of the wrong packaging paper and incomplete packaging of coins is prevented.

When the apparatus includes a paper supply/discharge switch, the comparator preferably executes comparison when paper supply control is manually selected by the paper supply/discharge switch.

BRIEF DESCRIPTION OF THE DRAWINGS

FIG. 3 is a list of recommended paper widths of packaging paper corresponding to coin type and unit numbers of coins per package;

DETAILED DESCRIPTION OF THE PREFERRED EMBODIMENT

Explained below is an embodiment of the coin packaging apparatus according to the invention.

Figure 1:
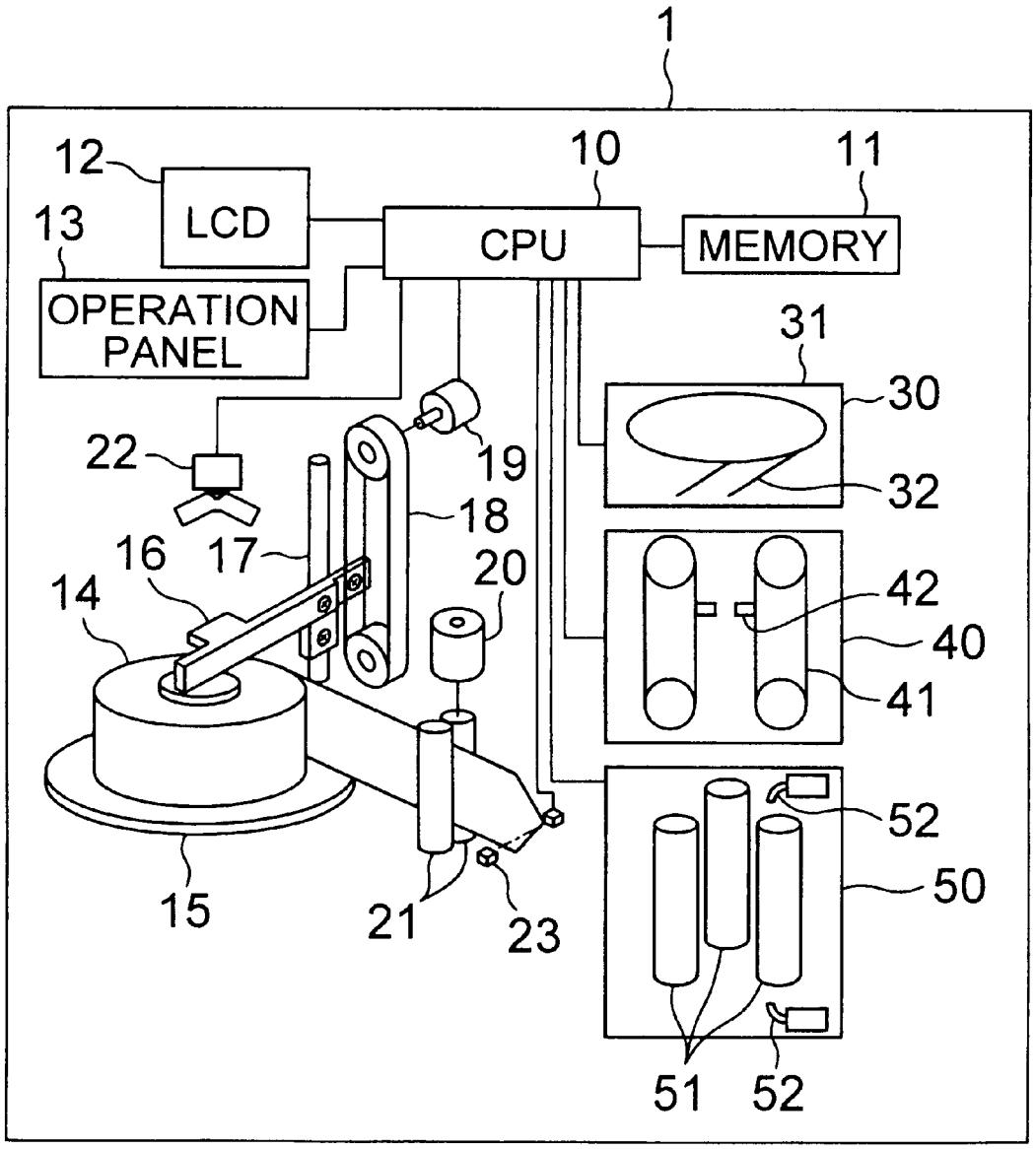
FIG. 1 is a schematic diagram partly showing the structure of a coin packaging apparatus according to an embodiment of the invention.
Figure 2:
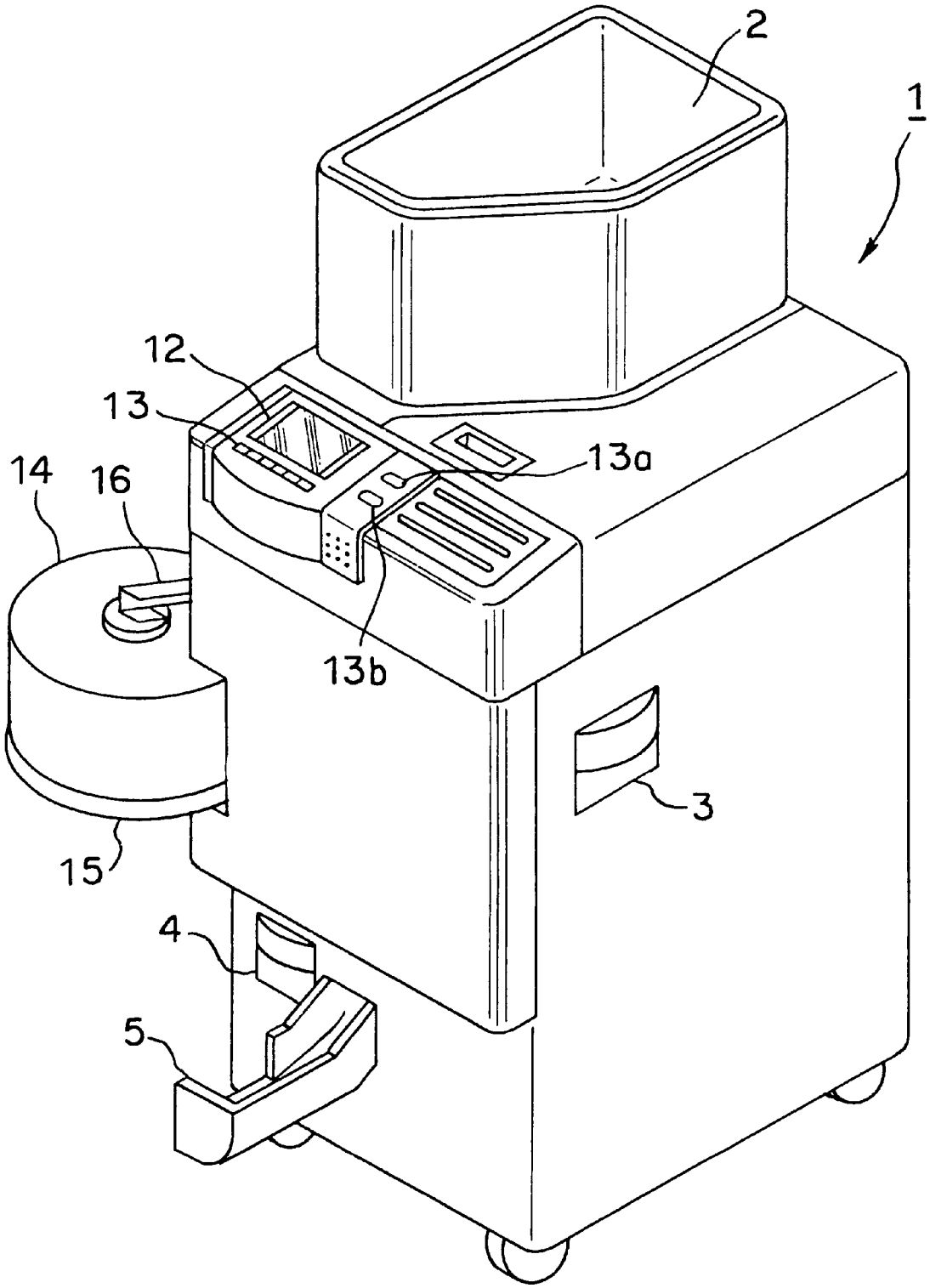
FIG. 2 is a perspective view showing an outline of a coin packaging apparatus according to an embodiment of the invention.

FIG. 1 is an explanatory diagram schematically showing a part of the structure related to the invention in the embodiment of the coin packaging apparatus according to the invention. FIG. 2 is a perspective view showing an outline structure of the embodiment of the coin packaging apparatus according to the invention.

The coin packaging apparatus 1 according to the invention shown in FIGS. 1 and 2 includes a coin insertion hopper 2 open to the top portion of the machine unit. A coin supply portion 30 has a second coin supply rotating plate 31 driven to rotate to supply coins delivered from a first coin supply rotating plate (not shown) driven to rotate on to receive and supply coins inserted into the coin insertion hopper 2 so as to have these coins processed one by one. A coin passage 32 extends substantially tangential to the second coin supply rotating plate 31 to perform separation, counting and other processing of the coins supplied from the second coin supply rotating plate 31. A coin stacking portion 40 has a coin hold portion 42 and a coin stack belt 41 located at one end of the coin passage 32 to stack a selected number of coins in the form of a rod. A coin packaging portion 50 has three packaging rollers 51 which are located under the coin stacking portion 40 to receive a rod of stacked coins from the coin stacking portion 40 and wind packaging paper 14 with a paper width longer than the length of the rod of stacked coins onto the side surface of the rod of stacked coins. A pair of fold-and-press heads 52 are located near the top end and the bottom end of the packaging rollers 51 to fold and tightly press the upper and lower ends of the packaging paper 14 wound around the side surface of the rod of stacked coins.

A packaging paper table 15, supported for free rotation, supports a roll of the packaging paper 14 set thereon. A paper supply/discharge motor 20 controls to supply or discharge of the packaging paper 14. A paper supply/discharge roller 21 is driven by the paper supply/discharge motor 20 to supply or discharge the packaging paper 14. A feed switch 22 is manually operated for paper supply control and paper discharge control to have the paper supply/discharge motor 20 execute paper supply and paper discharge. A position detecting sensor 23 detects that the leading edge of the packaging paper 14 fed from the paper supply/discharge roller 21 has reached a predetermined position. A cutter (not shown) cuts the packaging paper 14 to a predetermined length. A paper width detecting portion has a paper width detecting lever 16 fixed at a middle portion thereof to a lift shaft 17 for vertical movement together with the lift shaft 17 to be positioned at a height corresponding to the paper width of the packaging paper when one end thereof is put on a center of the roll of the packaging paper 14. A moving amount converting portion 18 includes a timing belt fixedly coupled to the other end of the paper width detecting lever 16 rotated in response to an up or down movement of the paper width detecting lever 16 and its support pulley shaft. A potentiometer 19 is coupled to the pulley shaft of the moving amount converting portion 18 to output the rotating amount of the pulley shaft as a paper width detection signal corresponding to the paper width of the packaging paper 14.

Memory 11 stores information on coin types and thicknesses of coins to be packaged and recommended paper widths of packaging paper corresponding to the coin types and unit numbers of coins in rods of stacked coins per package, among other things. An LCD 12 displays the status of a packaging operation, the status of each portion in the machine unit, and other information. A setting portion 13 enables manipulation of setting conditions of a packaging operation and other manipulation (including a start/stop button 13*a* for a starting or stopping command of the operation, a clear button 13*b* for clearing the operation, currently selected conditions or display, and so on). A central processing unit (CPU) controls calculation of the paper width of a roll of packaging paper 14 actually set, comparison between the value of the recommended paper width of the packaging paper corresponding to the set type and the set unit number of coins per package with the value of the calculated value of the paper width, and other setting and processing of the entire coin packaging apparatus. A small-diameter coin excluding portion 3 excludes coins with smaller diameters than the diameter of coins to be packaged. A fraction coin discharge portion 4 discharges coins remaining as fractions after packaging of the coins. A packaged coin discharge portion 5 is located under part of the machine unit to discharge packaged rods of stacked coins.

In the coin packaging machine 1 according to the invention, the distal end of the paper width detecting lever 16 is put on the roll of packaging paper 14 set on the packaging paper table 15. At a predetermined time before the packaging of coins is started, the CPU 10 calculates the paper width of the roll of packaging paper 14 set on the packaging paper table 15 from paper width detection data in the paper width detection signal generated and transmitted to the CPU 10 by the potentiometer 19 in response to the moving amount of the moving amount converting portion 18, then reads out from the memory 11 the recommended paper width data of packaging paper corresponding to the set coin type and the set unit number of coins per package, which is entered and set in the CPU from the setting portion 13. If the results of comparison show that the calculated paper width value is within a predetermined allowable range for the recommended paper width value, the CPU 10 judges that the packaging paper is correct, and undertakes the subsequent processing. If the calculated paper width value is out of the allowable range for the recommended paper width value, the CPU 10 judges that the packaging paper is wrong. Then the CPU 10 displays the judgement and a recommended paper width value on the LCD. Consequently, the currently gripped packaging paper 14 by the paper supply/discharge roller 21 is discharged automatically or manually.

Since the notice that the packaging paper is wrong and the recommended paper width value are displayed on the LCD 12, supply of the wrong packaging paper and incomplete packaging of coins is prevented. The operator can immediately recognize that the displayed abnormality points out the incorrectness of the packaging paper and the recommended paper width of the packaging paper fitting the coin type and the unit number of coins per package. Therefore, the operator can quickly cope with this by replacing the wrong packaging paper with one meeting the coin type and the unit number of coins per package.

Additionally, since the paper supply/discharge roller 21 is operative for discharging paper, unlike the conventional paper supply roller exclusive for paper supply operation, the wrong packaging paper 14 gripped by the paper supply/discharge roller 21 can be discharged quickly.

In the case of discharging the packaging paper 14 manually, it is recommended to invalidate paper supply control by the feed switch 22 and to permit paper discharge control alone. Erroneous feeding of the wrong packaging paper and incomplete packaging of coins is then prevented.

FIG. 3 is a list of exemplary representation of recommended paper widths of packaging paper for types and number of coins to be packaged. In this example, recommended paper widths of packaging paper meeting with coin types used in the U.S. and unit numbers of coins are shown.

Recommended paper width for packaging 50 one-cent coins is 97.0 mm, and recommended paper widths for packaging 20 five-cent coins and 40 of the same coins are 60.5 mm and 99.0 mm, respectively. Recommended paper width for packaging 50 ten-cent coins is 88.5 mm, and recommended paper widths for packaging 20 twenty five-cent coins and 40 of the same coins are 57.0 mm and 91.5 mm, respectively. Recommended paper width for packaging 20 fifty-cent coins is 64.5 mm. Recommended paper width for packaging 25 one-dollar coins is 71.5 mm, and recommended paper with for packaging 20 tokens (medal-shaped pieces used for getting on subways) is 74.0 mm.

Next is an explanation of specific display contents by the LCD 12 and of the setting portion 13.

Figure 4:
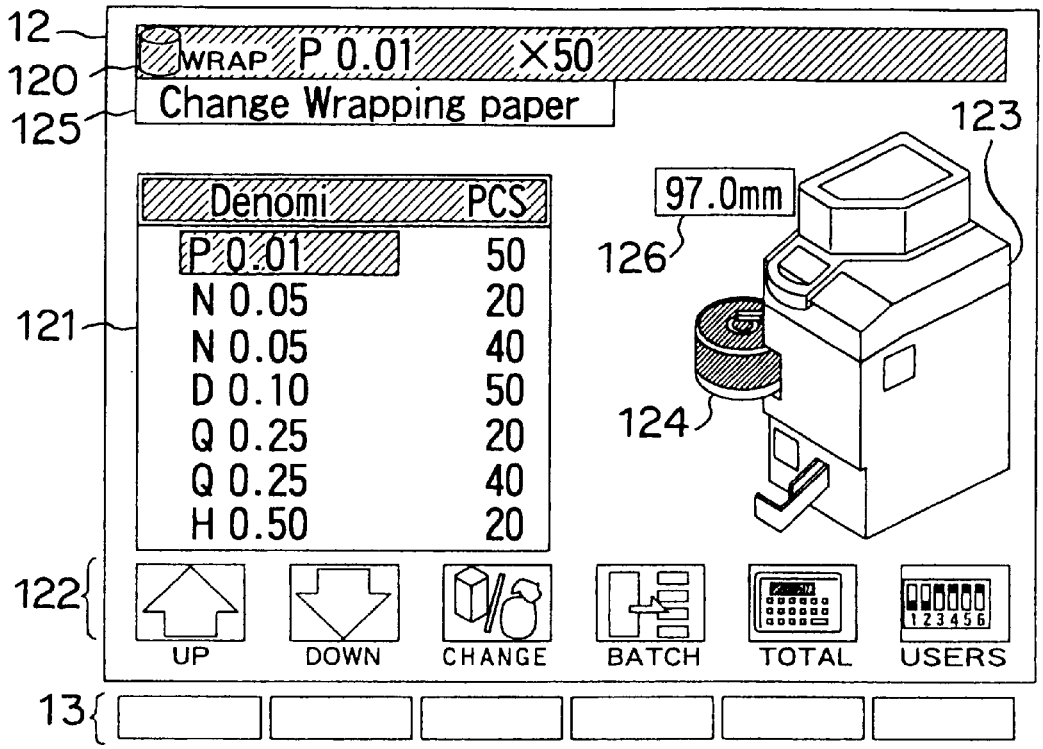
FIG. 4 is an explanatory diagram showing an example of a display of a notice that the current packaging paper is wrong and the value of the recommended paper width.
Figure 5:
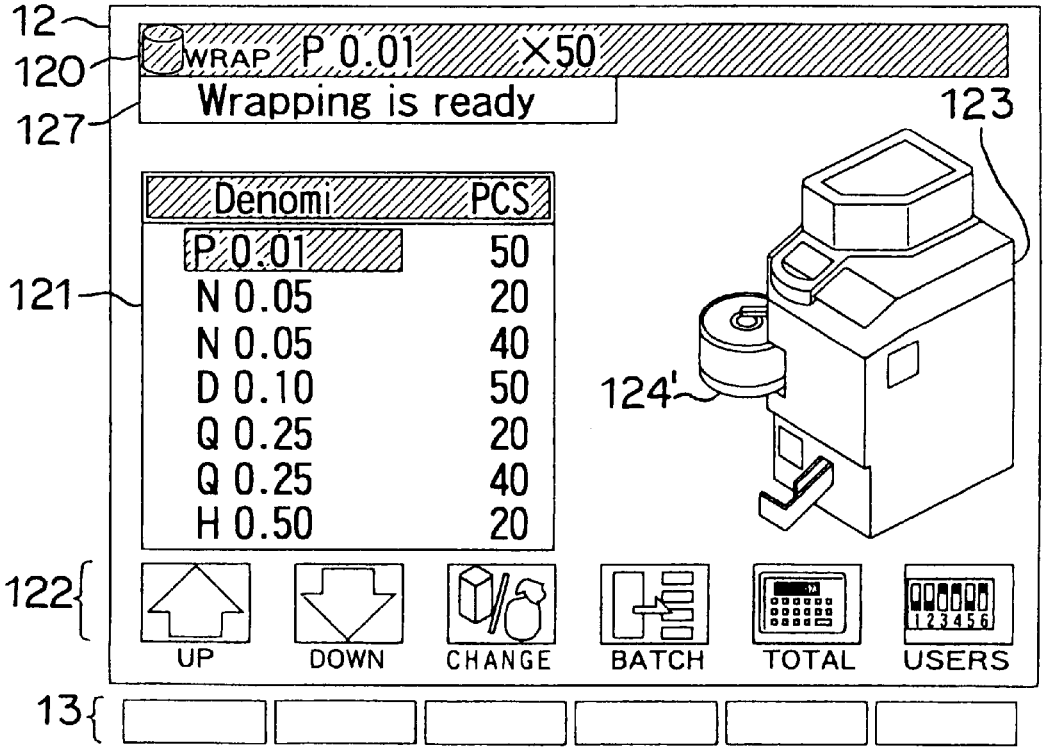
FIG. 5 is an explanatory diagram showing an example of a display of a notice that the current packaging paper is correct and the apparatus is ready for a normal packaging operation.

FIG. 4 is an explanatory diagram showing an example of the display of a notice that the packaging paper is wrong and the value of recommended paper width. FIG. 5 is an explanatory diagram showing an example of a display of a notice that the packaging paper is correct and the apparatus is ready for a normal packaging operation.

As explained above, as a result of comparison between the calculated paper width value and the recommended paper width value by the CPU 10 in the coin packaging apparatus 1, if the calculated paper width value is out of a predetermined allowable range for the recommended paper width value, the CPU 10 judges that the packaging paper is wrong, and has this notice and a recommended paper width value displayed on the LCD 12. FIG. 4 shows an example of such dsiplay.

Displayed on the LCD 12 shown in FIG. 4 are the currently set coin type and unit number of coins per package 120, coin types and unit numbers of coins which can be selected to package them 121, icons 122 representing functions of respective operational keys on the setting portion 13, a display notifying the user of an abnormality of the packaging paper, i.e. the incorrectness of the packaging paper, 124 (periodically repeating normal display and highlighted display of the packaging portion in the illustration), a notice instructing the user to replace the packaging paper 125, and recommended paper width value of packaging paper meeting the currently set coin type and unit number of coins per package 126. In the display 121 of possible coin types and unit numbers of coins per package, P means "penny" (one-cent coin), N means "nickel" (five-cent coin), D means "dime" (ten-cent coin), Q means "quarter" (25-cent coin), and H means "half' (50-cent coin), and any of these coin types and unit numbers of coins per package can be selected through operation keys in the setting portion 13 corresponding to icons of "UP and "DOWN".

Since there are displayed the dispaly 124 indicating that the packaging paper is wrong and the dispaly 125 instructing the user to replace the packaging paper, together with the dispaly 126 of the recommended paper width value of the packaging paper which meets the currently set coin type and unit number of coins per package, the operator can immediately recognize the need for replacement of packaging paper and the type of packaging paper suitable for the coin type and unit number of coins per package. Thus the operator can quickly deal with this by exchanging the wrong packaging paper with correct packaging paper for the coin type and unit number of coins per package.

Displayed on the display portion 12 shown in FIG. 5 are the currently set coin type and unit number of coins per package 120, coin types and unit numbers of coins which can be selected to package them 121, icons 122 representing functions of respective operational keys on the setting portion 13, a display indicating the correctness of the packaging paper that is currently set 124' (merely displaying the packaging portion in the illustration in the normal way), and a display 127 indicating that the apparatus is ready to start a coin packaging operation.

When the correct packaging paper for the coin type and unit number of coins per package is set, on the display is as shown in FIG. 5, and the operator can confirm this display and can perform the necessary operation for starting the coin packaging process.

Next are three methods, regarding which timing is suitable for comparing the calculated paper width value and the recommended paper width value in the coin packaging apparatus according to the invention.

Figure 6:
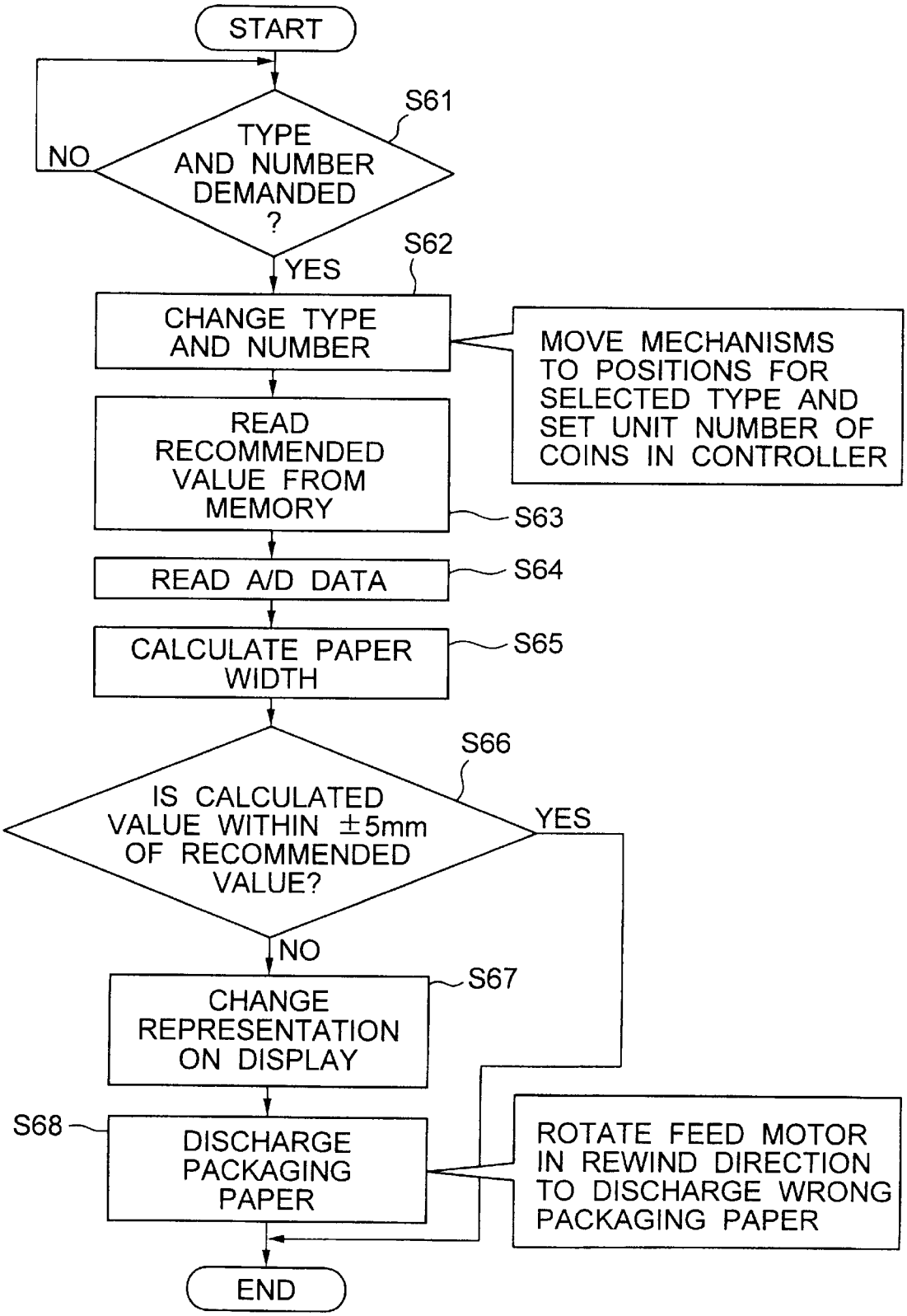
FIG. 6 is a flow chart showing a procedure of a first method for comparing the value of the calculated paper width with the value of the recommended paper width in the coin packaging apparatus according to the invention.

FIG. 6 is a flow chart showing a procedure of a first method for comparing the calculated paper width value and the recommended paper width value in the coin packaging apparatus according to the invention. The first method shown in FIG. 6 executes comparison between the calculated paper width value and the recommended paper width value upon changing the selection of the coin type and unit number of coins per package.

When changing the selection of the coin type and unit number of coins per package is demanded by operation through operation keys of the setting portion 13 which correspond to "UP" and "DOWN" of the icons 122 (step S61), the coin packaging apparatus according to the invention changes the coin type and unit number of coins per package (step S62). That is, respective mechanisms are moved to positions for the newly set coin type and unit number of coins per package, are set in the CPU (controller) 10. The CPU 10 reads out from the memory 11 recommended paper width data of packaging paper corresponding to the set coin type and unit number of coins per package (step S63), and reads out a paper width detection data (digital data) in a paper width detection signal generated and transmitted to CPU 10 by an AD converter in the potentiometer 19 in response to the height of the paper width detection lever 16 (step S64). Further, CPU 10 calculates the paper width of the roll of packaging paper 14 set on the packaging paper table 15 from the paper width detection data obtained (step S65), and compares the calculated paper width value with the recommended paper width value (step S66).

If the calculated paper width value is within the predetermined allowable range for the recommended paper width value (in this case, ±5 mm) as a result of the comparison, the CPU 10 judges it to be correct packaging paper and executes subsequent processing (step S66). If the calculated paper width value is out of the predetermined allowable range for the recommended paper width value, the CPU 10 judges it to be the wrong packaging paper and changes the display on the LCD 12 as shown in FIG. 4 to display representation 124 indicating the incorrectness of the packaging paper, representation 125 instructing the operator to replace the packaging paper and a representation of recommended paper width value 126 (step S67). Simultaneously, it controls discharge of the packaging paper 14 currently gripped by the paper supply/discharge roller 21 (step S68). That is, it controls the paper supply/discharge motor (feed motor) 20 to rotate in the opposite direction from the direction for supplying paper.

As explained above, by executing a comparison between the calculated paper width value and the recommended paper width value upon changing a selection of the coin type and unit number of coins per package, it is prevented that the wrong paper is erroneously supplied and the coins are incompletely packaged.

Figure 7:
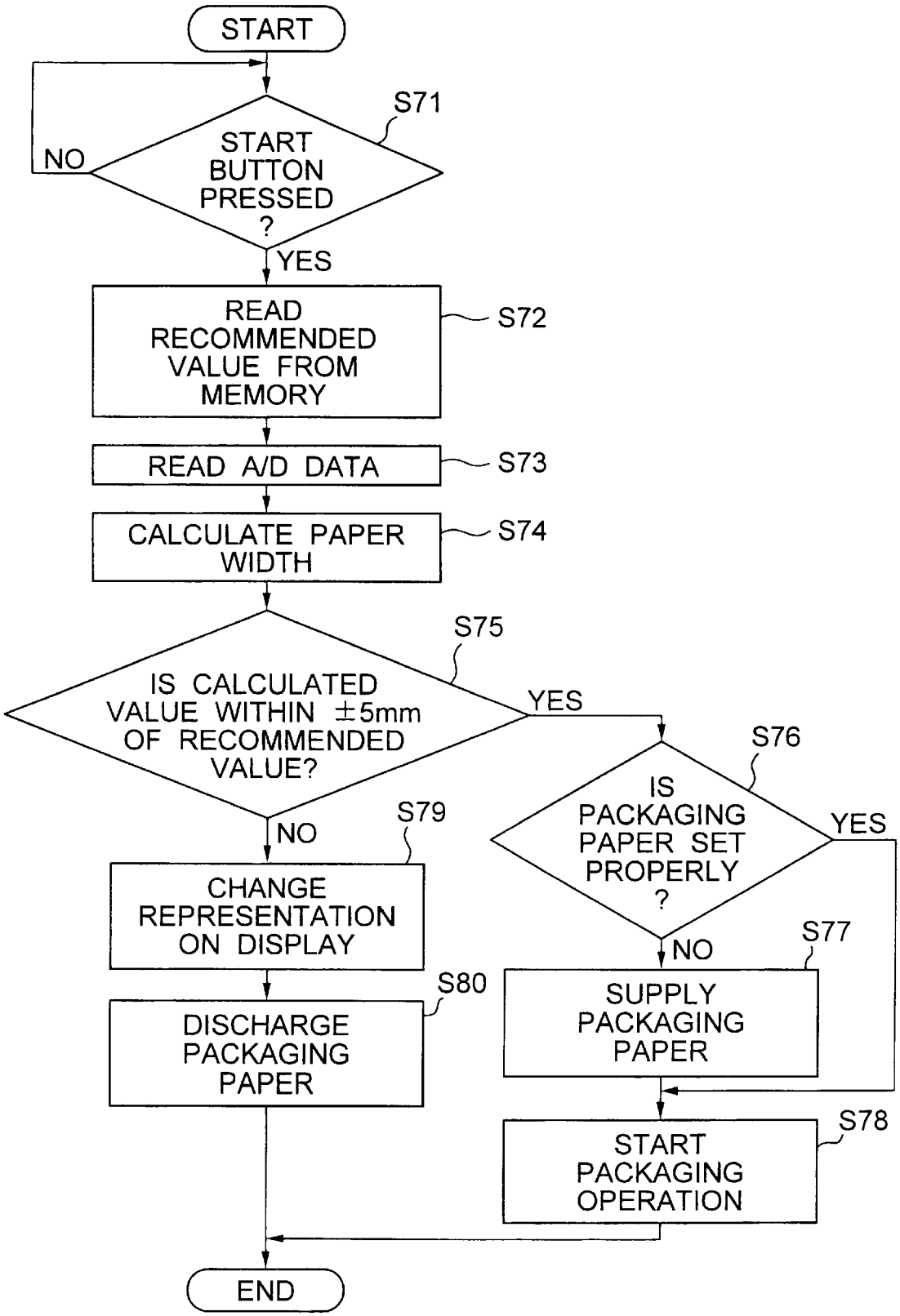
FIG. 7 is a flow chart showing a procedure of a second method for comparing the value of the calculated paper width with the value of the recommended paper width in the coin packaging apparatus according to the invention.

FIG. 7 is a flow chart showing a procedure of the second method for comparing the calculated paper width value and the recommended paper width value in the coin packaging apparatus according to the invention. The second method shown in FIG. 7 executes a comparison between the calculated paper width value and the recommended paper width value when a command to start the packaging operation is entered.

When a command to start the packaging operation is entered, that is, when the start button 13*a* is pressed (step S71), the CPU 10 read out from the memory 11 a recommended paper width data of packaging paper corresponding to the set coin type and unit number of coins per package (step S72), and read out a paper width detection data (digital data) in the paper width detection signal generated and transmitted to CPU 10 by the AD converter in the potentiometer 19 in response to the height of the paper width detection lever 16 (step S73). Further, CPU 10 calculates the paper width of the roll of packaging paper 14 set on the packaging paper table 15 from the paper width detection data obtained (step S74), and compares the calculated paper width value with the recommended paper width (step S75).

If the calculated paper width value is within the predetermined allowable range for the recommended paper width value (in this case, ±5 mm) as a result of the comparison, CPU 10 judges that the packaging paper is correct, and confirms through the position detecting sensor 23 that the packaging paper is fed out by the paper supply/discharge roller 21 and correctly set at the predetermined position (step S76). If the packaging paper is not detected by the position detecting sensor 23, CPU 10 makes the paper supply/discharge roller 21 feed out and supply the packaging paper (step S77), and thereafter starts packaging operation (step S78). If the position detecting sensor 23 certainly detects the packaging paper in the predetermined position, the packaging operation is started directly (step S78).

On the other hand, if the calculated paper width value is out of the predetermined allowable range for the recommended paper width value, CPU 10 judges that the packaging paper is wrong, and changes the display on the display 12 as shown in FIG. 4 to the display representation 124 indicating the incorrectness of the packaging paper, the representation 125 indicating the need for replacement of the packaging paper and the representation of the recommended paper width value 126 (step S79). Simultaneously, it controls discharge of the packaging paper 14 gripped by the paper supply/discharge roller 21 (step S80).

As explained above, by executing a comparison between the calculated paper width value and the recommended paper width value upon entry of the command to start the packaging operation, it is prevented that wrong paper is erroneously supplied and coins are incompletely packaged even if the packaging paper is replaced by the wrong packaging paper while the power source of the coin packaging apparatus is OFF, for example.

Figure 8:
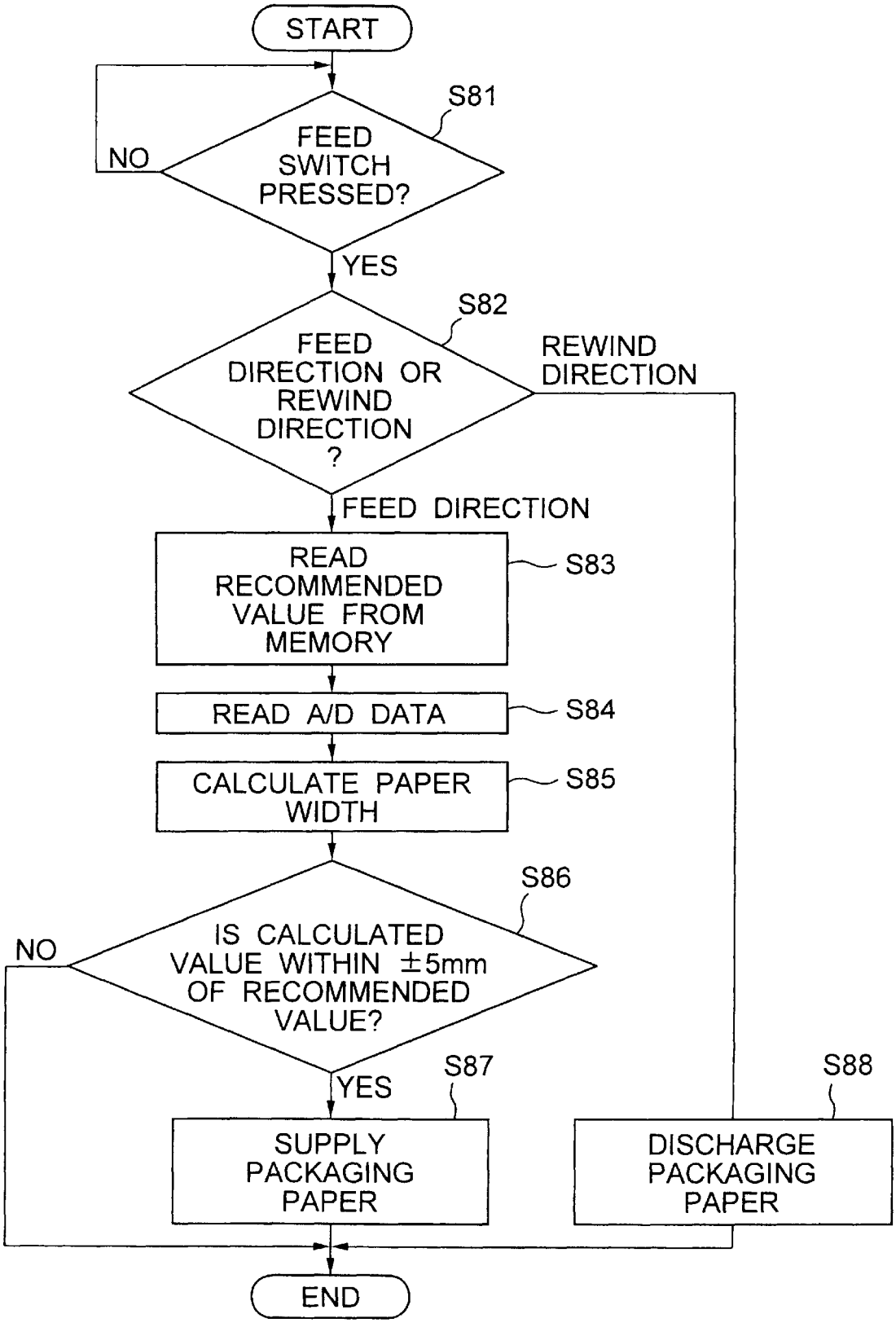
FIG. 8 is a flow chart showing a procedure of a third method for comparing the value of the calculated paper width with the value of the recommended paper width in the coin packaging apparatus according to the invention.
Figure 9:
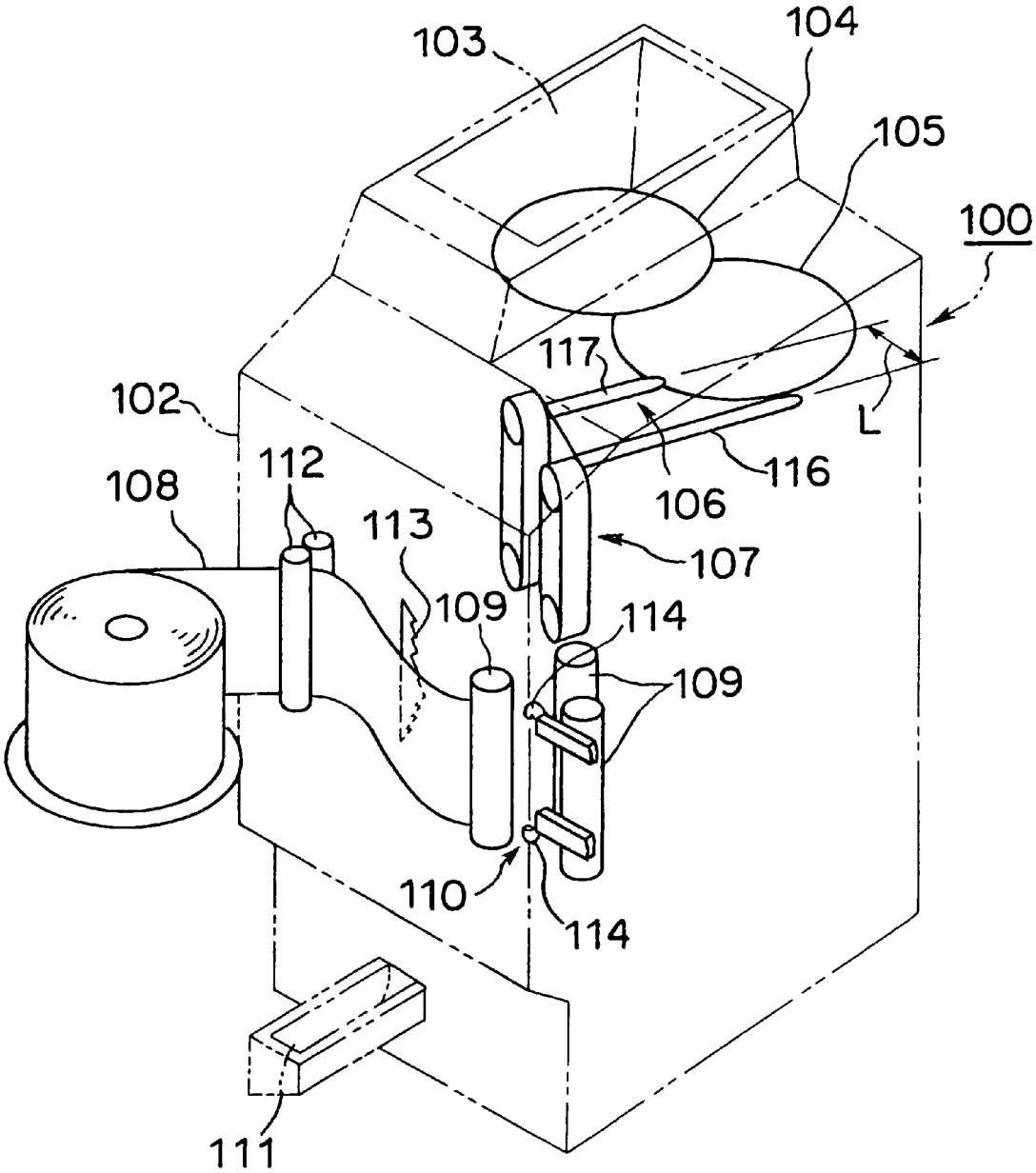
FIG. 9 is a perspective view showing an outline of a conventional coin packaging apparatus.

FIG. 8 is a flow chart showing a procedure of the third method for comparing the calculated paper width value and the recommended paper width value in the coin packaging apparatus according to the invention. The third method shown in FIG. 8 executes comparison between the calculated paper width value and the recommended paper width value when packaging paper is replaced or newly set.

After a roll of packaging paper 14 is set on the packaging paper table 15 and the distal end of the paper width detection lever 16 is put on the center of the roll of packaging paper 14, when the feed switch 22 is pressed to have the paper supply/discharge roller 21 grip the leading edge of the packaging paper (step S81), if the feed switch 22 is pressed for the paper supply side (paper feeding side) (step S82), the CPU 10 reads out from the memory 11 recommended paper width data of packaging paper corresponding to the set coin type and unit number of coins per package (step S83), and reads out paper width detection data (A/D data) in the paper width detection signal generated and transmitted to CPU 10 by the AD converter in the potentiometer 19 in response to the height of the paper width detection lever 16 (step S84). Further, the CPU calculates the paper width of the roll of packaging paper 14 set on the packaging paper table 15 from the paper width detection data obtained (step 585), and compares the calculated paper width value with the recommended paper width value (step S86).

If the calculated paper width value is within the predetermined allowable range for the recommended paper width value (in this case, ±5 mm) as a result of the comparison, the CPU 10 judges that the packaging paper is correct, and has the packaging paper supplied (step S87). If the calculated paper width value is out of the predetermined allowable range for the recommended paper width value, the CPU 10 judges that the packaging paper is wrong. Then it invalidates feed supply control by the feed switch 22 and makes the paper discharge control alone effective.

On the other hand, if the feed switch 22 is pressed to the paper discharge side (paper rewind side) (step S82), the CPU 10 does not perform comparison between the calculated paper width value and the recommended paper width value, and discharges the packaging paper 14 gripped by the paper supply/discharge roller 21 (step S88).

As explained above, by executing comparison between the calculated paper width value and the recommended paper width value when packaging paper is replaced or newly set, and invalidating paper feed control by the feed switch 22 in case of the wrong packaging paper, it is prevented that the wrong paper is erroneously set In the coin packaging apparatus according to the invention, the comparator compares the paper width value of packaging paper detected by the paper width detecting device with the recommended paper width value at a predetermined timing before starting a coin packaging operation, to progress the operation under a judgement that the packaging paper is correct if the result of the comparison indicates that the calculated paper width value is within the predetermined allowable range for the recommended paper width value, and to display the incorrectness of the packaging paper and the recommended paper width value and have the packaging paper gripped by the paper supply/discharge device be discharged automatically or manually under judgement that the packaging paper is wrong if the calculated paper width value is out of the predetermined allowable range for the recommended paper width value. Therefore, the supply of the wrong packaging paper and incomplete packaging of coins thereby can be prevented, and operators can immediately recognize that a currently existing abnormality indicates the incorrectness of the packaging paper and can know the recommended paper width suitable for the coin type and unit number of coins per package. Thus, the operator can quickly deal with it by replacing the wrong packaging paper with the correct packaging paper suitable for the coin type and unit number of coins per package.

The paper supply/discharge device is operative to automatically discharge paper as well when the packaging paper is judged to be wrong, unlike the conventional paper supply roller exclusive for paper supply. Therefore, the wrong packaging paper gripped by the paper supply/discharge device can be discharged quickly.

When packaging paper is exchanged or newly set, and supply or discharge of packaging paper is executed by the paper supply/display switch, if the packaging paper is judged to be wrong, the paper supply control by the paper supply/discharge switch is invalidated, and paper discharge control alone is permitted. Therefore, the erroneous setting of the wrong packaging paper can be prevented.

What is claimed is:

1. A coin packaging apparatus comprising:

a setting device that can be operated to set conditions of a coin packaging operation, the conditions including coin type and unit number of coins per package, and to receive a command to start the packaging operation;

a memory which stores information including coin types, unit numbers of coins per package, and recommended paper width values of packaging paper;

a coin stacking device which stacks coins of the type and unit number set by the setting device in the form of a rod;

a paper supply device which supplies packaging paper to be used for packaging the rod of coins stacked said coin stacking device;

a coin packaging device which winds said packaging paper around the rod of coins stacked by said coin stacking device and folds and presses upper and lower ends of the packaging paper to package the rod of coins;

a paper width detecting device which detects the paper width of the packaging paper of said paper supply device;

a comparator which compares the value of the paper width of the packaging paper detected by said paper width detecting device with a predetermined allowable range for a recommended paper width value of packaging paper of the packaging paper suitable for a set coin type and unit number of coins per package; and a display which displays a representation of incorrectness of the packaging paper and the recommended paper width value when the result from said comparator indicates that the paper width value of the packaging paper detected by said paper width detecting device is outside of the predetermined allowable range for the recommended paper width value.

2. The coin packaging apparatus of claim 1, wherein said comparator is operable to compare the value of the paper width of the packaging paper detected by said paper width detecting device with a predetermined allowable range for a recommended paper width value of packaging paper of the packaging paper suitable for the set coin type and unit number of coins per package when the coin type and the unit number of coins per package are set through said setting device.

3. The coin packaging apparatus of claim 1, wherein said comparator is operable to compare the value of the paper width of the packaging paper detected by said paper width detecting device with a predetermined allowable range for a recommended paper width value of packaging paper of the packaging paper suitable for the set coin type and unit number of coins per package when a start command is received by said setting device.

4. A coin packaging apparatus comprising:

a setting device that can be operated to set conditions of a coin packaging operation, the conditions including coin type and unit number of coins per package, and to receive a command to start the packaging operation;

a memory which stores information including coin types, unit numbers of coins per package, and recommended paper width values of packaging paper;

a coin stacking device which stacks coins of the type and unit number set by the setting device in the form of a rod;

a paper supply/discharge device which is operable to supply packaging paper to be used for packaging the rod of coins stacked said coin stacking device and operable to discharges the packaging paper in a direction opposite from the direction for supplying the packaging paper;

a coin packaging device which winds said packaging paper around the rod of coins stacked by said coin stacking device and folds and presses upper and lower ends of the packaging paper to package the rod of coins;

a paper width detecting device which detects the paper width of the packaging paper of said paper supply/discharge device;

a comparator which compares the value of the paper width of the packaging paper detected by said paper width detecting device with a predetermined allowable range for a recommended paper width value of packaging paper of the packaging paper suitable for a set coin type and unit number of coins per package; and a paper discharge control device operable to control said paper supply/discharge device to discharge the packaging paper when the said comparator determines that the paper width value of the packaging paper is outside of the predetermined allowable range for the recommended paper width value.

5. The coin packaging apparatus of claim 4, wherein said comparator is operable to compare the value of the paper width of the packaging paper detected by said paper width detecting device with a predetermined allowable range for a recommended paper width value of packaging paper of the packaging paper suitable for the set coin type and unit number of coins per package when the coin type and the unit number of coins per package are set through said setting device.

6. The coin packaging apparatus of claim 4, wherein said comparator is operable to compare the value of the paper width of the packaging paper detected by said paper width detecting device with a predetermined allowable range for a recommended paper width value of packaging paper of the packaging paper suitable for the set coin type and unit number of coins per package when a start command is received by said setting device.

7. A coin packaging apparatus comprising:

a setting device that can be operated to set conditions of a coin packaging operation, the conditions including coin type and unit number of coins per package, and to receive a command to start the packaging operation;

a memory which stores information including coin types, unit numbers of of coins per package, and recommended paper width values of packaging paper;

a coin stacking device which stacks coins of the type and unit number set by the setting device in the form of a rod;

a paper supply/discharge device which is operable to supply packaging paper to be used for packaging the rod of coins stacked said coin stacking device and operable to discharge the packaging paper in a direction opposite from the direction for supplying the packaging paper;

a manually operated paper supply/discharge switch operable to control the execution of paper supply and paper discharge of said paper supply/discharge device;

a coin packaging device which winds said packaging paper around the rod of coins stacked by said coin stacking device and folds and presses upper and lower ends of the packaging paper to package the rod of coins;

a paper width detecting device which detects the paper width of the packaging paper of said paper supply/discharge device;

a comparator which compares the value of the paper width of the packaging paper detected by said paper width detecting device with a predetermined allowable range for a recommended paper width value of packaging paper of the packaging paper suitable for a set coin type and unit number of coins per package; and a paper supply/discharge switch control device operable to invalidate paper supply control by said paper supply/discharge switch and to permit only paper discharge control when said comparator determines that the paper width value of the packaging paper is outside of the predetermined allowable range for the recommended paper width value.

8. The coin packaging apparatus of claim 7, wherein said comparator is operable to compare the value of the paper width of the packaging paper detected by said paper width detecting device with a predetermined allowable range for a recommended paper width value of packaging paper of the packaging paper suitable for the set coin type and unit number of coins per package when said paper supply/discharge switch is manually operated for paper supply control.

* * * * *